United States Patent [19]

Neal et al.

[11] Patent Number: 4,863,277

[45] Date of Patent: Sep. 5, 1989

[54] AUTOMATED BATCH BLENDING SYSTEM FOR LIQUID FERTILIZER

[75] Inventors: Michael G. Neal, Ofallon, Ill.; David Junge, Cedar Rapids, Iowa

[73] Assignees: Vigoro Industries, Inc., Fairview Heights, Ill.; Junge Control, Inc., Cedar Rapids, Iowa

[21] Appl. No.: 288,141

[22] Filed: Dec. 22, 1988

[51] Int. Cl.[4] ..... B01F 15/02

[52] U.S. Cl. ..... 366/137; 366/141; 366/163

[58] Field of Search ..... 366/136, 137, 138, 141, 366/153, 159, 162, 165, 167, 163, 18

[56] References Cited

U.S. PATENT DOCUMENTS

| | | | |
|---|---|---|---|
| 945,143 | 1/1910 | Szamek . | |
| 1,540,592 | 6/1925 | Best . | |
| 2,017,867 | 10/1935 | Nantz | 366/136 |
| 2,900,176 | 8/1959 | Krogel | 366/159 |
| 3,174,835 | 3/1965 | Stratford . | |
| 3,447,201 | 6/1969 | Seanor et al. . | |
| 3,653,639 | 4/1972 | Mueller . | |
| 3,871,272 | 3/1975 | Melandri | 366/137 |
| 4,323,313 | 4/1982 | Oberg et al. . | |
| 4,436,429 | 3/1984 | Strong et al. . | |
| 4,544,279 | 10/1985 | Rudolph | 366/141 |
| 4,571,088 | 2/1986 | Frensch | 366/136 |
| 4,764,019 | 8/1988 | Kaminski | 366/136 |

*Primary Examiner*—Robert W. Jenkins

*Attorney, Agent, or Firm*—Jones, Tullar & Cooper

[57] ABSTRACT

A system for automated batch blending of materials such as liquid fertilizers is disclosed. Liquid and dry products are supplied to a product mixing holding tank by way of valve-controlled inlet lines. A control panel responsive to the weight of the material added to the holding tank regulates the operation of the valves and of a recycling pump which mixes the product. The system permits small quantities of product to be produced under automatic control.

14 Claims, 2 Drawing Sheets

AUTOMATED BATCH BLENDING SYSTEM FOR LIQUID FERTILIZER

BACKGROUND OF THE INVENTION

The present invention relates, in general, to a mixing system for the production of materials such as fertilizers, and more particularly to an automated batch blending system for liquid fertilizer.

Prior art systems for the manufacture of fertilizer have generally been manually controlled and consist of fluid batch blending devices which produce 10 to 15 tons of fertilizer per batch, with hourly production ranging from 30 to 100 tons. Such systems require from 10 to 20 horsepower per ton to operate, so that the cost for building and operating such a system, and the production rates which it requires, are so high, that retail outlets cannot justify their installation and use. As a result, fertilizer must be made at central locations and transported to the retail outlets for storage, with consequent increased costs and reduced efficiency.

SUMMARY OF THE INVENTION

The present invention is directed to a mixing system for the production of materials such as fertilizers, wherein selected ingredients are added under controlled conditions to produce the final result. Both liquid and dry products are mixed in the process, with some of the mixing taking place in a venturi line and in a product recycling line and other materials being added directly to a product/mixing holding tank. A control system automatically regulates control valves in response to measured conditions and further in accordance with a predetermined sequence by which specified quantites of material are added to the product in sequence to produce the final product.

More particularly, the invention includes a weighing and mixing hopper, or tank, containing a circulating tank eductor for mixing the contents of the hopper. The hopper is supported by a load beam for weighing the contents of the hopper and a float sensor is provided to prevent overfilling. An upper manifold is provided for supplying materials to the mixing hopper, this manifold receiving water, liquid clay, and aqua, or optionally, anhydrous ammonia, by way of remotely controllable inlet valves for supply to the hopper. The manifold also receives product liquid from the discharge line of a venturi loop leading from a venturi jet where dry ingredients are added to the product.

A recycling mixing loop is also provided for the hopper, the recycling loop receiving product liquid from the bottom of the hopper by way of a mixing pump which supplies the product under pressure to a vertical manifold. This manifold includes a venturi loop outlet valve for directing product to the venturi jet, includes an inlet for supplying a phosphate base to the recycled product, includes an outlet line leading to a storage tank, and includes an outlet line which leads to the circulating tank eductor in the hopper to complete the recycling loop. All of these inlet and outlet lines from the vertical manifold are controlled by remotely operated valves whereby the material from the mixing hopper can be directed to the venturi, to storage, or mixed with material such as a phosphate base, and recycled.

The venturi loop outlet from the vertical manifold leads to a venturi jet to which is connected a dry hopper for supplying dry ingredients to the product liquid in the venturi loop. This flow of product liquid creates a vacuum in the venturi jet which causes dry material to be injected into the liquid system. The dry hopper is connected to the venturi jet through a valve which is remotely controlled. A suitable auger, also remotely controlled, supplies the dry ingredient to the dry hopper as required. The venturi loop discharge line is connected to the upper manifold, as previously discussed.

A control panel for the system includes selector switches for regulating the various valves, pumps, the dry feed auger, and ingredient supplies. These control switches preferably have three positions, an "off" position, a "manual" position for manually controlling the respective system elements, and an "automatic" position which permits control of the respective system elements by means of a suitable programmable controller such as a microprocessor located in the control panel. The control panel preferably also includes a key panel for entry of control data into the microprocessor, whereby the operator can program the microprocessor to select the sequence and timing of the various operations so as to control the composition of the batch. Indicator lamps provide a visual indication of the operation of each of the system elements, and a suitable readout panel permits monitoring of the readings obtained from the scale used to measure the weight of the materials in the mixing hopper, and allows a comparison of measured and target values. A hold switch may also be provided on the control panel to permit entry of data into the system without causing automatic operation of the controlled system elements, and also permits manual operation of the system.

In operation, the recycling loop for the mixing hopper is opened by opening the recycle valve, and water is supplied to the mixing hopper by way of the incoming water line and the upper manifold. The weight of the mixing hopper is measured by the load scale, is displayed on the control panel and when that weight reaches a selected target value, the water valve closes. Thereafter, the valve controlling the supply of liquid clay is opened and a measured quantity of that material is supplied to the mixing hopper. This is followed by similar additions of aqua and phosphate base, with the scale providing measurements of the quantities of materials added. When these steps have been completed, the mixing pump is turned on and product from the mixing hopper is blended by circulating the material through the vertical manifold in the recycle loop and through the circulating tank eductor. This is done for a predetermined blend time and thereafter dry induction is initiated as long as the pressure in the recycle loop is above a certain value.

To carry out dry induction, the venturi loop inlet valve leading to the venturi loop from the vertical manifold is opened and the recycle valve is closed. The dry hopper valve is opened and dry ingredients are supplied to the product flowing through the venturi jet. The flow of liquid from the mixing hopper through the venturi jet causes dry material to be injected into the liquid stream, and this mixture is carried through the venturi discharge to the upper manifold where it is dropped into the weighing/mixing hopper for mixing and recirculation. When a predetermined weight of material has been added in this manner, the venturi loop is closed.

After dry induction, the recycle valve is opened and the mixing pump forces liquid through the recycle loop and through the recirculating tank eductor for a predetermined mix time. Thereafter, the recycle valve closes and the storage valve opens to discharge the blended batch to a storage tank. When the scale display on the control panel nears zero, indicating that the mixing hopper is empty, the mixing pump is turned off and the entire process may be repeated. This process requires three to eight minutes for completion and produces a maximum batch size of about 2,000 lbs, a size that is conveniently suited to the needs of retail operators at a reasonable cost. This allows small volume operators to manufacture liquid fertilizers on site rather than relying on a central manufacturing point, thus avoiding high freight and mixing charges.

BRIEF DESCRIPTION OF THE DRAWINGS

The foregoing and additional objects, features and advantages of the present invention will be apparent to those of skill in the art from a consideration of the following detailed description of a preferred embodiment thereof, taken in conjunction with the accompanying drawings in which.

DETAILED DESCRIPTION OF PREFERRED EMBODIMENT

Figure 1:
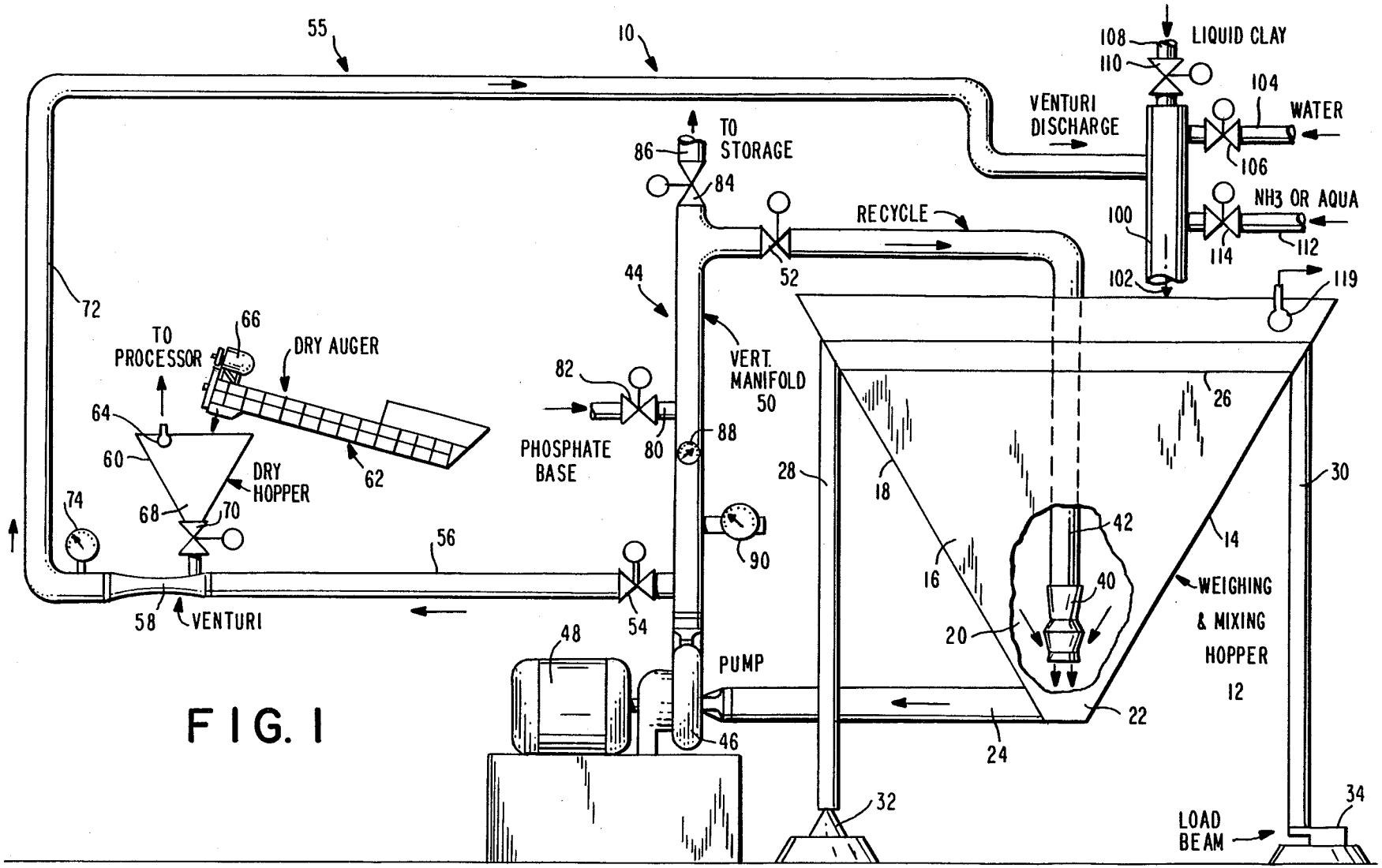
FIG. 1 is a schematic illustration of the system of the present invention.

Turning now to more detailed consideration of the present invention, there is illustrated in FIG. 1 a batch mixing system 10 for batch blending products such as liquid fertilizers in accordance with the present invention. The system incorporates a weighing and mixing hopper 12 which is generally rectangular, having four inwardly and downwardly sloping side walls 14, 16, 18 and 20 which slope toward a bottom apex 22 at which is located an outlet product flow line 24. The hopper 12 is supported by a circumferential frame 26 and three support legs such as those illustrated at 28 and 30. Two rear support legs 28 are provided, one at each rear corner of the generally rectangular hopper, with the legs 28 being mounted on pivots 32 to permit pivotal motion of the hopper 12. A front edge leg 30 is supported on a suitable scale such as load beam 34. This mounting arrangement permits the load beam scale to accurately weigh the contents of the mixing hopper as the material is added to it, so that accurate batch mixing can be carried out. The load beam is a conventional electronic load cell, strain gauge, or other conventional weight measurement device. Mounted within the mixing hopper is a conventional circulating tank eductor 40, such as that manufactured by Penberthy Houdaille of Profitstown, Illinois, carried at the lower end of a recycling flow pipe 42, the eductor outlet being located near the apex 22 of the hopper. Eductor 40 provides agitation and mixing of the product constituents within the mixing hopper 12 during recycling of product through a recycling loop generally indicated at 44.

The recycling loop 44 includes the outlet product flow line 24 which leads from the apex 22 of hopper 12 to the inlet of a high pressure process pump 46 driven by an electric motor 48. The outlet of the pump supplies liquid product to the lower end of a vertical manifold 50 which, in turn, is connected at its upper end through a recycle valve 52 to the product recycling flow pipe 42, completing the recycling loop 44.

Connected near the bottom of the vertical manifold 50 is a venturi loop inlet valve 54 leading to a venturi loop 55. The valve 54 outlet is connected by way of product flow line 56 to a venturi jet 58 such as the "jet pump" manufactured, for example, by Penberthy Houdaille of Profitstown, Illinois. The jet pump allows dry, fine, soluble ingredients to be introduced into the liquid product stream from a dry hopper 60 into which the dry ingredients are fed by means of a dry auger 62. The hopper 60 includes a level sensor 64 which detects the level of material in the dry hopper and controls the operation of an auger drive motor 66 to control the flow of dry ingredients into the hopper. The outlet 68 of the dry hopper is connected by way of a hopper valve 70 to the venturi 58, this valve being opened to allow a flow of material into the venturi when liquid is flowing through line 56 and venturi 58. Such a liquid flow causes the dry material to be injected into the liquid stream and to be mixed into that stream. The valve 70 closes when the venturi jet is not operating to prevent liquid from back flowing into the hopper. The output of the venturi 58 is supplied to a venturi discharge line 72 and is returned to the weighing and mixing hopper 12 to complete loop 55, as will be described.

It will be noted that a pressure gauge 74 is provided at the downstream end of the venturi 58 for permitting an operator to monitor the pressure of the venturi discharge. This pressure will normally be in the range of zero to 5 psi.

The vertical manifold in the recycling loop 44 also is connected to a feed line 80 which incorporates an inlet control valve 82. Feed line 80 is connected, for example, to a source of phosphate base material in liquid form which is supplied to the vertical manifold under suitable pressure. The phosphate material may be supplied from a suitable storage tank by means of a pump (not shown) or from a similar supply source.

The top end of the vertical manifold 50 is connected through a storage valve 84 to a discharge line 86 which leads to a storage tank (not shown) for storage of a completed liquid fertilizer batch. The vertical manifold includes a high pressure gauge 88 for visual monitoring of the pressure in the manifold, which may range up to 100 psi, and also includes an automatic pressure gauge 90 which provides an output signal for use in monitoring the process pressures during automatic control. This latter gauge provides an output to the control panel (to be described) for the system for use in determining control parameters.

Located above the open top of the weighing and mixing hopper 12 is an upper manifold 100, the lower end of which opens into the mixing hopper 12, as indicated by the arrow 102. Manifold 100 is connected to discharge flow line 72 and thus receives the product discharge by the venturi 58, which product is then dispensed into the hopper 12. Manifold 100 is also connected to a water line 104 by way of a water control valve 106, is connected to a liquid clay supply line 108 by way of a clay supply valve 110 and is connected to an incoming aqua (liquid nitrogen) line 112 by way of control valve 114. Alternatively, the supply line 112 may be connected to a source of anhydrous ammonia ($NH_3$) from a separate anhydrous ammonia venturi loop.

The hopper incorporates a detecting switch 119 at its top for measuring the product level of the hopper. This switch produces an output signal when the level exceeds a predetermined valve to close down all of the inputs to the system so as to prevent overflow.

Figure 2:
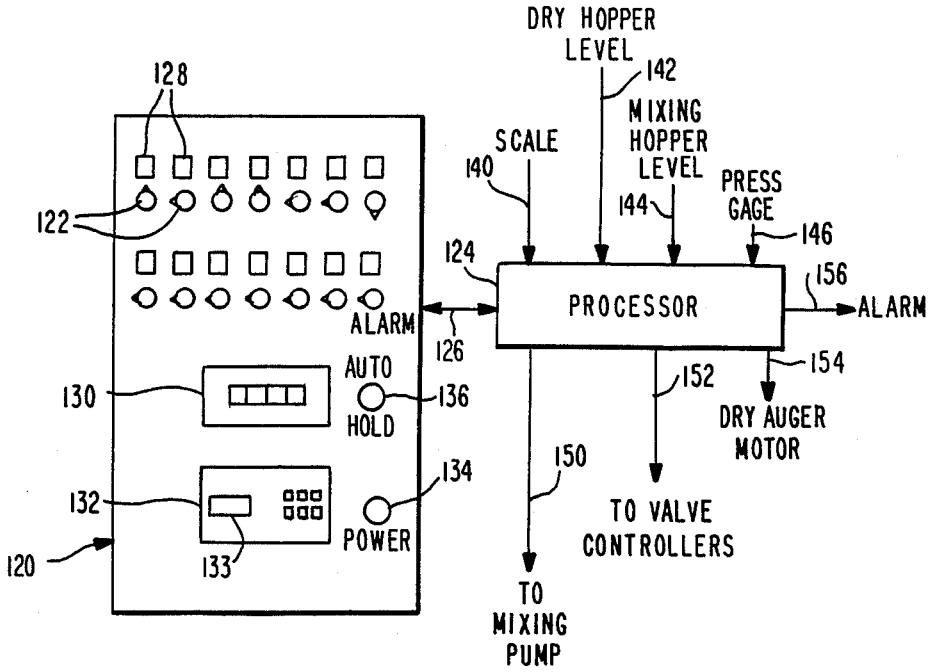
FIG. 2 is a diagrammatic illustration of the control panel for the system of FIG. 1.

As illustrated in FIG. 2, a control panel 120 is provided for regulating the operation of the system of FIG. 1. The control panel incorporates a plurality of manually operated switches 122 which preferably are three position switches that can be set to an "off" position, a "manual" position, or to an "automatic" position, by the system operator. Each switch is connected so that when it is in the manual position, the switch activates its corresponding system element and when it is turned off, that element is also turned off. Thus, if the switch is connected to operate the motor 48, switching it to manual will turn the motor and pump on, and switching it to the off position will shut the pump down. The automatic position of the switch 122 places the operation of that system element under the control of a programmable controller 124 which may be a microprocessor and which is located in the control panel and connected to the switch of the panel by way of cable 126. The microprocessor then operates the element in accordance with a predetermined program or sequence to provide the desired fertilizer product. Adjacent each of the switches 122 is a corresponding indicator lamp 128 which indicates when the corresponding system element is activated.

The control switches 122 provide automatic-off-manual selective operation for the water valve 106, the phosphate valve 82, a phosphate pump (not shown), the aqua valve 114, the clay valve 110, the dry auger feed 66, the recycle valve 52, the discharge valve 84, the venturi valve 54, the venturi hopper valve 70, the mixing pump 46 and the optional alarm. A control switch may also be provided for an optionally available recycling loop for the anhydrous ammonia supply (not shown) as well as other control elements that may be desired. Switches may also be provided to control the input signals from the dry hopper switch 64 and from the automatic pressure gauge 90 if desired.

The control panel also includes a digital scale readout display 130 which provides a display of the actual weight of the material in the mixing hopper 12 to permit the operator to monitor the operation of the system. The panel also includes an entry keypad 132 by which instructions concerning the operation of the system are entered into the processor 124 and a keypad display 133 which displays target weights for each stage of the mixing process. Power switch 134 on panel 120 provides a master power control for the system, while the auto/hold switch 136 when in the "hold" position places the system in a hold condition to permit entry of data or instructions into the processor 124, or to permit manual operation of the system. Switching the switch 136 to the auto position permits automatic operation of the batch process.

Processor 124 receives input signals on line 140 from the load beam scale 34 to provide continuous information concerning the weight of the hopper 12. Input line 142 provides a signal from the level sensor 64 on dry hopper 60, which signal is used to regulate the operation of the auger drive motor 66. When the system is in operation, the sensor determines whether the hopper 64 contains the dry ingredient for the mixing process, and if not, causes the auger 62 to supply such material until the hopper is full.

Line 144 receives signals from the level switch 119 located at the top of the mixing hopper 12. This signal is a shutdown signal which occurs when the hopper 12 is overfull and in response to such a signal the processor shuts down any inlet lines which might be supplying additional material to the batch.

Line 146 provides inputs from the pressure gauge 90 and, if desired, from pressure gauge 74 and similar gauges connected in the input lines 80, 108, 104, or 112 to insure that sufficient liquid pressure is available for the proper operation of the system. The processor supplies control signals by way of output line 150 to the drive motor 48 of mixing pump 46 to regulate the operation of that pump in accordance with the batch process. This signal is provided in accordance with the program sequence of operation of the batch process so that the product liquid is cycled through the recycle loop 44 and through the venturi loop 55 to provide the required mixing of the constituent elements of the product.

Output line 152 from processor 124 supplies control signals to the several control valves which regulate the flow of material in the system of FIG. 1. These valves may be any suitable electrically controllable valves which respond to signals on line 152 for opening and closing. The processor produces the appropriate signals, for example digital control signals, together with valve addresses, to select the valves for operation in accordance with the program sequence established by the system operator. The output line 154 from microprocessor 124 provides control signals for the auger motor 66 in response to level signals received from sensor 64 by way of line 42, as previously discussed. The motor 66 activates the dry auger 62 to supply material to the hopper 60 as required.

Line 156 from processor 124 provides an alarm signal in response to selected failures in the system. Thus, for example, an overfill signal from sensor 119 which results in a shut down of the system may also be used to activate an alarm by way of line 156.

To operate the system of FIG. 1, the operator first switches the auto/hold switch 136 to its hold position so as to prevent automatic operation of the system. The power is then turned on by means of switch 134 and the scale display 130 comes up and displays the weight of the mixing hopper 12. At the beginning of the cycle, the hopper 12 should be substantially empty. The scale display should then read zero, and if it does not, then calibration may be required. Thereafter, if the formula is not preprogrammed, the operator keypad 132 may be used to enter the desired formula weights for the batch to be mixed into the processor 124. These weights are determined by the desired end product and determine the quantities of water, clay, aqua, phosphate, and any dry ingredients such as phosphorous. Upon entry of these formula weights, the switch 136 is turned to the "automatic" position to permit the mixing process to begin.

In the preferred form of the invention, the processor 124 establishes a sequence of valve openings and pump operation which mixes the ingredients in the following sequence. First of all, the recycle valve 52 is opened so that the recycling loop 44 is ready for operation. The water valve 106 is then opened and water is supplied to the mixing hopper. The weight of the hopper changes as water is supplied, and this measured weight is displayed on the scale display 130. The signals from the scale load beams 34 are supplied to the microprocessor by way of line 140, with the microprocessor furnishing the display 130 on the control panel. The processor also monitors the scale weight and when that weight reaches the target scale weight, which is displayed at 133, as established by the formula, the water valve 106 closes.

In similar manner, the clay valve 110, the aqua valve 114 and the phosphate base valve 82 are opened in sequence and liquid under pressure is supplied through the respective supply lines and through manifold 100 to the hopper or through manifold 50 and product flow pipe 42 to the mixing hopper 12. In each case, target weight for the material being added is established, and when scale 34 indicates that this weight has been reached, the corresponding valve is closed. These valves are operated sequentially so that first one valve is opened, its material is supplied to the mixing hopper, the weight being added to the hopper is monitored, and when the target weight is reached that valve is shut down and the next valve opened and the measuring cycle is repeated.

After each of the valves 110, 114, and 80 have been opened and then closed upon delivery of their respective materials, the microprocessor 124 provides a mixing signal by way of line 150 to the mixing pump 46, energizing the motor 48 to drive the pump and to circulate the product from the mixing hopper 12 through the recycling loop 44. The pump draws liquid product from the bottom of hopper 12 through product flow line 24, through the pump, upwardly through the vertical manifold 50, through the open valve 52 and the recycling line 42, through the eductor 40 and back into the hopper 12. This operation continues for a predetermined blend time which is sufficient to insure a complete mixing and blending of the materials added to the hopper.

At the end of the blend time for the liquid product in hopper 12, the dry ingredient is then added. This accomplished by opening the venturi inlet valve 54, but this occurs only if the pressure gauge 90 provides a signal on line 146 indicating that the pressure is above a predetermined level. If it is not above this level, the flow through the venturi will not provide a sufficient induction of dry material into the liquid product. When the venturi valve 54 is opened, the recycle valve 52 is closed to prevent liquid from bypassing the venturi loop 55. The hopper valve 70 is then opened and the flow of liquid through the venturi induces dry ingredient from hopper 60 to flow through the valve 70 and into the flowing liquid product. This material flows into the venturi discharge line 72 and is carried to the manifold 100 where it is dropped into the mixing hopper 12.

During the addition of dry ingredients, the dry auger 62 will be operated in response to signals on line 154 from the microprocessor whenever the level switch 64 indicates that the dry ingredient level in the hopper 60 is below a predetermined level. Thus, the dry auger operates to keep the hopper 60 full to insure addition of the proper quantity of dry ingredient to the product. The quantity of dry ingredient is measured by the load beam scale 34, as previously described, with the output from the scale being supplied to the microprocessor by way of line 140. When the scale indicates that sufficient dry material has been added to the product; that is, when the hopper 12 reaches a predetermined weight, the valve 70 is closed.

Upon completion of the dry induction process in the venturi loop 55, the recycle valve 52 is reopened and the mixing pump, which continues to operate, forces liquid around the recycle loop 44 and thus through the eductor 40. The flow may also continue through the venturi discharge loop 55 for a time to insure that the product in that line is completely recycled to produce a thorough blending of the product constituents. At the end of this predetermined mixing time, the storage valve 84 is opened, the recycle valve 52 is closed, the venturi valve 54 is closed (if it has not already been closed) and the blended batch is pumped to a storage tank by way of line 86. The pumping continues until the scale display returns to zero, indicating that the hopper 12 is empty, at which time the mixing pump 46 is turned off and the process is complete.

It will be noted that any time the high level shut down switch 119 in the mixing hopper 12 is activated, the operation of the valves controlling the incoming ingredients are deactivated and will not function until the system is reset.

Typical raw materials for the system 10 are as follows:

TABLE I

| | | |
|---|---|---|
| | DRY MATERIALS | |
| Potash ($K_2O$) | 62.4% K Fine | 71 lbs/ft$^3$ |
| MAP | 10-50-0 Powder | 67 lbs/ft$^3$ |
| MAP | 10-52-0 Granular | 67 lbs/ft$^3$ |
| MAP | 11-53-0 Granular | 67 lbs/ft$^3$ |
| DAP | 18-46-0 Granular | 62 lbs/ft$^3$ |
| Clay | (Attadulgite) Powder/Gran. | 50 lbs/ft$^3$ |
| Limestone | Fine | 82 lbs ft$^3$ |
| Urea | 45% N | 41 lbs/ft$^3$ |
| | WET MATERIAL | |
| Water | | 8.345 lbs/gal. |
| Aqua | (22–29% total Nitrogen) | 8 lbs/gal. |
| Phosphate Bases | 8-24-0 Suspension | 11.4 lbs/gal. |
| | 10-30-0 Suspension | 11.4 lbs/gal. |
| | 10-34-0 Clear | 11.4 lbs/gal. |
| Phosphoric Acid | (54% phosphate) | 14.25 lbs/gal. |
| Liquid clay | 25% dry wht. | 10 lbs/gal. |
| Urea-ammonium-nitrate | 28-0-0 | 10.67 lbs/gal |

where "MAP" is mono-ammonium phosphate, and where "DAP" is D-ammonium phosphate.

These materials are mixed in accordance with the formula programmed into the microprocessor of the present invention.

The following tables illustrate the amounts of materials used for several fertilizer mixtures produced in accordance with the present invention:

TABLE II

| Formulation: | 1.7-5-30 | 2-6-34 | 3.3-10-30 | 0-0-34 | 0-0-42 |
|---|---|---|---|---|---|
| Water | 522 lbs | 315 lbs | 127 lbs | 710 lbs | 534 lbs |
| Clay | 99 | 95 | 78 | 200 | 120 |
| 8-24-0 | 417 | 500 | 833 | | |
| Potash | 962 | 1090 | 962 | 1090 | 1346 |
| % Water | 40 | 32 | 30.5 | 43 | 31 |

TABLE III

| Formulation | 10-30-0 (Using 11-52-0 MAP) | 8-24-0 (Using 10-50-0 MAP) |
|---|---|---|
| Water | 444 lbs | 676 lbs |
| Clay | 100 | 100 |
| Aqua | 302 | 264 |
| MAP | 1154 | 960 |
| % Water | 41 | 51 |

TABLE IV

| Formulation | Liquid Lime |
|---|---|
| Water | 800 lbs |
| 200 Mesh Lime | 1200 |

In the foregoing formulations, liquid clay is 25% dry and the balance is water.

To calculate the amounts ofmaterials required in the 8-24-0 formulation of Table III, for example, the formula is first multiplied by 20, yielding a 160-480-0 formulation. If the MAP formulation is 10-50-0, then the amount of MAP required is 480/0.50=960 pounds. The Nitrogen is obtained from the Aqua and the MPA. From 960 pounds of MAP the nitrogen available is 0.10×960=96 units of N. The amount required from the Aqua is 160−96=64 units. With 24.2% Aqua being used. 64 units/0.242=264 pounds of Aqua. The amount of clay is 100 pounds per ton of product, giving the total of 2,000 pounds of product set out in this example.

To calculate the amounts of material required for the 2-6-34 formulation in Table II, the formula is first multiplied by 20 to obtain 40-120-680 units. The phosphate source is the 8-24-0, which yields 120/0.24=500 lbs. The nitrogen from the 8-24-0 is 500×0.08=40 units of N. Since 40 units of N are what is required, it is not necessary to add $NH_3$ to the product. Potash (62.4%) required is 680/0.624=1090 lbs. The liquid clay calculation is as follows. 120 lb/ton of liquid clay is needed. There is 100 lb/ton of liquid clay in the 8-24-0, so this material yields 100/2000×500=25 lb of clay. Thus, 120−25=95 lb of liquid clay is required for each batch.

The system as described above may utilize a mixing hopper of up to about 300 gallons to allow mixing of small batches of products such as liquid fertilizer. This system provides a simple, easy to use and inexpensive fertilizer production facility which is suitable for use by retail outlets, and thus meets a significant need in the industry. Although the present invention has been disclosed in terms of a preferred embodiment, it will be apparent that variations and modifications may be made without departing from the true spirit and scope thereof, as set forth in the accompanying claims, in which:

What is claimed is:

1. A mixing system for the production of liquid products, comprising a mixing hopper for receiving constituents of a product;

means continuously measuring the weight of product in said hopper;

a first manifold for receiving product constituents and discharging said constituents into said hopper;

a plurality of constituent input lines leading to said first manifold;

an input control valve in each said input line for regulating the flow of constituent material to said manifold;

a mixing hopper outlet connected to said mixing hopper;

a recycling loop connected between said mixing hopper outlet and the interior of said mixing hopper, said recycling loop including a second manifold;

pump means connected between said mixing hopper and said second manifold, a recycling flow line connected between said second manifold and the interior of said mixing hopper, and a recycling valve in said recycling flow line;.

a venturi loop having an inlet end connected to said pump means and a discharge end connected to said first manifold, said venturi loop including a venturi jet, an inlet product flow line connecting said pump means to said venturi jet, a venturi discharge line connecting said venturi jet to said first manifold, and a venturi control valve connected in said venturi loop;

a product constituent inlet line having a corresponding control valve connected to said second manifold; and dry ingredient supply means connected to said venturi jet and responsive to the flow of product through said venturi jet to induct dry ingredients into said venturi for delivery to said mixing hopper, and a dry ingredient control valve connected between said dry ingredient supply means and said venturi jet.

2. The mixing system of claim 1, further including control means connected to said pump means and said control valves to regulate the supply of constituent materials and dry ingredients to the product in said mixing hopper and to regulate the flow of product in said recycling and venturi loops, and to regulate the operation of said pump to control the circulation of liquid in said system.

3. The mixing system of claim 2, wherein said control means operates said constituent control valves sequentially in response to a predetermined formulation for said product.

4. The mixing system of claim 3, wherein said control means opens selected valves to supply constituent materials to said product and closes said open constituent control valves in response to predetermined output weight signals from said means for measuring the weight of said product in said hopper.

5. The mixing system of claim 4, wherein said recycling flow line includes an eductor means at the end thereof in said mixing hopper whereby the flow of liquid in said recycling loop mixes said product.

6. The mixing system of claim 4, further including level sensing switch means on said hopper for producing an output signal upon the occurrence of a high product level in said mixing hopper; and wherein said control means includes means responsive to said level switch output signal for closing all said control valves.

7. The mixing system of claim 4, wherein said control means includes microprocessor means for operating said control valves.

8. The mixing system of claim 7, wherein said control means includes data input means connected to said microprocessor means for establishing in said microprocessor the formulation of said product, whereby said control valves are operated in a selected sequence to supply selected weights of constituent materials to said product, and whereby said pump is activated to circulate the product in said recycling and said venturi loops for mixing and blending said product.

9. The mixing system of claim 8, wherein at least three input lines with corresponding input control valves are connected to said first manifold.

10. The mixing system of claim 9, wherein at least a fourth input line and corresponding input control valve is connected to said second manifold.

11. The mixing system of claim 10, wherein said second manifold includes an inlet end connected to said pump and an outlet end connected to said recycling flow line, and further includes a storage outlet flow having having a storage control valve connected to said outlet end.

12. The mixing system of claim 11, wherein the inlet end of said venturi loop is connected to said inlet end of said second manifold.

13. The mixing system of claim 12 wherein said microprocessor means includes output control lines for individually regulating each of said control valves.

14. The mixing system of claim 13, wherein said microprocessor means includes an output control line for regulating the operation of said mixing pump to circulate product in said mixing system, the circulation of product through said recycling loop, venturi loop and said storage loop being regulated by the operation of said recycling, venturi, and storage valves, respectively.

* * * * *